US010316616B2

(12) United States Patent
Stafford et al.

(10) Patent No.: US 10,316,616 B2
(45) Date of Patent: Jun. 11, 2019

(54) DISSOLVABLE BRIDGE PLUG

(75) Inventors: Jack Stafford, Carrollton, TX (US); Billy Greeson, Sugar Land, TX (US); John Fleming, Damon, TX (US); Manuel P. Marya, Sugarland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 12/855,503

(22) Filed: Aug. 12, 2010

(65) Prior Publication Data

US 2011/0048743 A1 Mar. 3, 2011

Related U.S. Application Data

(63) Continuation-in-part of application No. 11/427,233, filed on Jun. 28, 2006, now Pat. No. 8,211,247.

(60) Provisional application No. 60/746,097, filed on May 1, 2006.

(51) Int. Cl.
*E21B 33/134* (2006.01)

(52) U.S. Cl.
CPC ..... *E21B 33/134* (2013.01)

(58) Field of Classification Search
CPC ..... E21B 33/1208; E21B 33/134; E21B 23/00
USPC ..... 166/373, 376, 377, 179, 135, 192
See application file for complete search history.

(56) References Cited

U.S. PATENT DOCUMENTS 2,261,292 A * 11/1941 Salnikovan ..... E21B 29/02 166/291
2,279,136 A 4/1942 Funk
2,558,427 A 6/1951 Fagan
2,779,136 A 1/1957 Hood et al.
3,106,959 A * 10/1963 Huitt ..... E21B 43/26 166/285
3,311,956 A 4/1967 Townsend et al.
3,316,748 A 5/1967 Lang et al.
3,348,616 A 10/1967 Zingg
3,687,135 A 8/1972 Borodkin et al.
3,938,764 A 2/1976 McIntyre et al.
4,157,732 A * 6/1979 Fonner ..... E21B 43/11 166/376

(Continued)

FOREIGN PATENT DOCUMENTS

CN 101326340 A 12/2008
DE 2818656 A1 10/1979

(Continued)

OTHER PUBLICATIONS

International Search Report and Written Opinion of PCT Application No. PCT/US2011/047296 dated Feb. 10, 2012.

(Continued)

*Primary Examiner* — Robert E Fuller

(57) ABSTRACT

A dissolvable bridge plug configured with components for maintaining anchoring and structural integrity for high pressure applications. These components may substantially dissolve to allow for ease of plug removal following such applications. The plug may effectively provide isolation in a cased well for applications generating over about 8,000-10,000 psi. At the same time, by employment of a dissolve period for the noted components, such a plug may be drilled-out in less than about 30 minutes, even where disposed in a lateral leg of the well.

20 Claims, 5 Drawing Sheets

(56) References Cited

U.S. PATENT DOCUMENTS 4,270,761 A 6/1981 Hertz, Jr.
4,285,398 A * 8/1981 Zandmer et al. ..... 166/100
4,450,136 A 5/1984 Dudek et al.
4,652,274 A 3/1987 Boettcher et al.
4,664,816 A 5/1987 Walker
4,735,632 A 4/1988 Oxman et al.
4,856,584 A 8/1989 Seidner
4,859,054 A 8/1989 Harrison
4,871,008 A 10/1989 Dwivedi et al.
4,898,239 A 2/1990 Rosenthal
4,903,440 A 2/1990 Kirk et al.
4,906,523 A 3/1990 Bilkadi et al.
4,919,209 A 4/1990 King
4,923,714 A 5/1990 Gibb et al.
5,057,600 A 10/1991 Beck et al.
5,178,646 A 1/1993 Barber et al.
5,188,183 A 2/1993 Hopmann et al.
5,204,183 A 4/1993 McDougall et al.
5,236,472 A 8/1993 Kirk et al.
5,284,207 A 2/1994 Bittleston et al.
5,355,956 A * 10/1994 Restarick ..... E21B 43/11 166/229
5,417,285 A 5/1995 Van Buskirk et al.
5,434,395 A 7/1995 Storck et al.
5,479,986 A 1/1996 Gano et al.
5,485,745 A 1/1996 Rademaker et al.
5,526,881 A * 6/1996 Martin et al. ..... 166/296
5,542,471 A 8/1996 Dickerson
5,566,757 A 10/1996 Carpenter et al.
5,573,225 A 11/1996 Boyle et al.
5,709,269 A * 1/1998 Head ..... 166/376
5,765,641 A 6/1998 Shy et al.
5,826,661 A 10/1998 Parker et al.
5,898,517 A 4/1999 Weis
5,944,123 A 8/1999 Johnson
5,965,826 A 10/1999 Von Bertrab
5,992,250 A 11/1999 Kluth et al.
6,009,216 A 12/1999 Pruett et al.
6,012,526 A 1/2000 Jennings et al.
6,024,158 A 2/2000 Gabathuler et al.
6,062,311 A 5/2000 Johnson et al.
6,079,281 A 6/2000 Oszajca et al.
6,145,593 A * 11/2000 Hennig ..... 166/313
6,155,348 A 12/2000 Todd
6,157,893 A 12/2000 Berger et al.
6,162,766 A 12/2000 Muir et al.
6,168,755 B1 1/2001 Biancaniello et al.
6,173,771 B1 1/2001 Eslinger et al.
6,192,983 B1 2/2001 Neuroth et al.
6,209,646 B1 4/2001 Reddy et al.
6,241,021 B1 6/2001 Bowling
6,247,536 B1 6/2001 Leismer et al.
6,261,432 B1 7/2001 Huber et al.
6,276,454 B1 8/2001 Fontana et al.
6,281,489 B1 8/2001 Tubel et al.
6,311,773 B1 11/2001 Todd et al.
6,346,315 B1 2/2002 Sawatsky
6,349,766 B1 2/2002 Bussear et al.
6,349,768 B1 2/2002 Leising
6,394,185 B1 * 5/2002 Constien ..... C09K 8/52 166/296
6,397,864 B1 6/2002 Johnson
6,419,014 B1 7/2002 Meek et al.
6,422,314 B1 7/2002 Todd et al.
6,444,316 B1 9/2002 Reddy et al.
6,457,525 B1 10/2002 Scott
6,474,152 B1 11/2002 Mullins et al.
6,494,263 B2 12/2002 Todd
6,519,568 B1 2/2003 Harvey et al.
6,527,051 B1 3/2003 Reddy et al.
6,531,694 B2 3/2003 Tubel et al.
6,534,449 B1 3/2003 Gilmour et al.
6,554,071 B1 4/2003 Reddy et al.
6,561,270 B1 5/2003 Budde
6,581,455 B1 6/2003 Berger et al.
6,607,036 B2 8/2003 Ranson et al.
6,632,527 B1 10/2003 McDaniel et al.
6,667,280 B2 12/2003 Chang et al.
6,725,929 B2 4/2004 Bissonnette et al.
6,737,385 B2 5/2004 Todd et al.
6,745,159 B1 6/2004 Todd et al.
6,789,621 B2 9/2004 Wetzel et al.
6,817,410 B2 11/2004 Wetzel et al.
6,854,522 B2 2/2005 Brezinski et al.
6,866,306 B2 3/2005 Boyle et al.
6,877,563 B2 4/2005 Todd et al.
6,878,782 B2 4/2005 Merfeld et al.
6,896,056 B2 5/2005 Mendez et al.
6,896,058 B2 5/2005 Munoz, Jr. et al.
6,918,445 B2 7/2005 Todd et al.
6,924,254 B2 8/2005 Todd
6,956,099 B2 10/2005 Pavlin
6,966,368 B2 11/2005 Farquhar
6,968,898 B2 11/2005 Todd et al.
6,971,448 B2 12/2005 Slabaugh et al.
6,976,538 B2 12/2005 Wilson et al.
6,983,798 B2 1/2006 Todd
7,000,701 B2 2/2006 Todd et al.
7,021,383 B2 4/2006 Todd et al.
7,036,586 B2 5/2006 Roddy et al.
7,036,588 B2 5/2006 Munoz, Jr. et al.
7,036,687 B1 5/2006 Lowe
7,044,220 B2 5/2006 Nguyen et al.
7,093,664 B2 8/2006 Todd et al.
7,140,437 B2 11/2006 McMechan et al.
7,152,685 B2 12/2006 Adnan et al.
7,168,494 B2 * 1/2007 Starr et al. ..... 166/379
7,182,134 B2 2/2007 Wetzel et al.
7,207,216 B2 4/2007 Meister et al.
7,285,772 B2 10/2007 Labous et al.
7,322,412 B2 1/2008 Badalamenti et al.
7,322,417 B2 1/2008 Rytlewski et al.
7,353,867 B2 4/2008 Carter et al.
7,353,879 B2 4/2008 Todd et al.
7,581,590 B2 9/2009 Lesko et al.
7,617,873 B2 11/2009 Lovell et al.
7,726,406 B2 6/2010 Xu
8,211,247 B2 7/2012 Mania et al.
8,220,554 B2 7/2012 Jordan et al.
8,663,401 B2 3/2014 Marya et al.
2002/0004060 A1 1/2002 Heublein et al.
2002/0007945 A1 1/2002 Neuroth et al.
2002/0017386 A1 2/2002 Ringgenberg et al.
2002/0125008 A1 9/2002 Wetzel et al.
2003/0070811 A1 * 4/2003 Robison et al. ..... 166/298
2003/0116608 A1 6/2003 Litwinski
2003/0150614 A1 8/2003 Brown et al.
2003/0224165 A1 12/2003 Anderson et al.
2004/0040707 A1 3/2004 Dusterhoft et al.
2004/0043906 A1 3/2004 Heath et al.
2004/0045705 A1 3/2004 Gardner et al.
2004/0084190 A1 5/2004 Hill et al.
2004/0129418 A1 7/2004 Jee et al.
2004/0188090 A1 9/2004 Vaeth et al.
2005/0016730 A1 1/2005 McMechan et al.
2005/0121192 A1 * 6/2005 Hailey et al. ..... 166/278
2005/0126777 A1 6/2005 Rolovic et al.
2005/0145308 A1 7/2005 Sailer et al.
2005/0145381 A1 7/2005 Pollard
2005/0161222 A1 7/2005 Haugen et al.
2005/0161224 A1 * 7/2005 Starr ..... E21B 33/12 166/376
2005/0173126 A1 8/2005 Starr et al.
2005/0189103 A1 9/2005 Roberts et al.
2005/0194141 A1 9/2005 Sinclair et al.
2005/0205264 A1 9/2005 Starr et al.
2005/0205265 A1 9/2005 Todd et al.
2005/0205266 A1 9/2005 Todd et al.
2005/0241824 A1 11/2005 Burris et al.
2005/0241825 A1 11/2005 Burris et al.
2005/0241835 A1 11/2005 Burris et al.
2005/0269083 A1 12/2005 Burns et al.
2006/0027359 A1 2/2006 Carter et al.
2006/0034724 A1 2/2006 Hamano et al.

(56) References Cited

U.S. PATENT DOCUMENTS

| | | | | |
|---|---|---|---|---|
| 2006/0035074 | A1 | 2/2006 | Taylor | |
| 2006/0037759 | A1 | 2/2006 | Braddick | |
| 2006/0042835 | A1 | 3/2006 | Guerrero et al. | |
| 2006/0044156 | A1 | 3/2006 | Adnan et al. | |
| 2006/0175059 | A1 | 8/2006 | Sinclaire et al. | |
| 2006/0207771 | A1 | 9/2006 | Rios et al. | |
| 2006/0249310 | A1 | 11/2006 | Stowe et al. | |
| 2006/0266551 | A1 | 11/2006 | Yang et al. | |
| 2007/0034384 | A1 | 2/2007 | Pratt | |
| 2007/0044958 | A1 | 3/2007 | Rytlewski et al. | |
| 2007/0107908 | A1 | 5/2007 | Vaidya et al. | |
| 2007/0137860 | A1 | 6/2007 | Lovell et al. | |
| 2007/0181224 | A1 | 8/2007 | Marya et al. | |
| 2008/0018230 | A1 | 1/2008 | Yamada et al. | |
| 2008/0066924 | A1 | 3/2008 | Xu | |
| 2008/0079485 | A1 | 4/2008 | Taipale et al. | |
| 2008/0105438 | A1 | 5/2008 | Jordan et al. | |
| 2008/0141826 | A1 | 6/2008 | Marya et al. | |
| 2008/0149345 | A1 | 6/2008 | Marya et al. | |
| 2008/0149351 | A1 | 6/2008 | Marya et al. | |
| 2008/0236842 | A1 | 10/2008 | Bhavsar et al. | |
| 2009/0025940 | A1 | 1/2009 | Rytlewski | |
| 2009/0050334 | A1 | 2/2009 | Marya et al. | |
| 2009/0126945 | A1 | 5/2009 | Sharma et al. | |
| 2009/0151936 | A1 | 6/2009 | Greenaway | |
| 2009/0151949 | A1 | 6/2009 | Marya et al. | |
| 2009/0226340 | A1 | 9/2009 | Marya | |
| 2009/0242189 | A1 | 10/2009 | Vaidya et al. | |
| 2010/0012708 | A1 | 1/2010 | Steward et al. | |
| 2010/0018703 | A1 | 1/2010 | Lovell et al. | |
| 2010/0209288 | A1 | 8/2010 | Marya et al. | |
| 2010/0212907 | A1 | 8/2010 | Frazier | |
| 2010/0252273 | A1* | 10/2010 | Duphorne | 166/376 |
| 2010/0270031 | A1* | 10/2010 | Patel | 166/376 |
| 2011/0036592 | A1 | 2/2011 | Fay | |
| 2011/0048743 | A1 | 3/2011 | Stafford et al. | |
| 2011/0067889 | A1* | 3/2011 | Marya et al. | 166/386 |
| 2011/0303420 | A1 | 12/2011 | Thorkildsen et al. | |

FOREIGN PATENT DOCUMENTS

| | | | |
|---|---|---|---|
| DE | 29816469 | U1 | 2/1999 |
| EP | 203249 | A2 | 12/1986 |
| EP | 178334 | B1 | 7/1990 |
| EP | 853249 | A1 | 7/1998 |
| EP | 0854439 | A2 | 7/1998 |
| EP | 1051529 | B1 | 12/2001 |
| EP | 1605281 | B1 | 5/2006 |
| GB | 666281 | A | 2/1952 |
| GB | 1187305 | A | 4/1970 |
| GB | 2177231 | A | 1/1987 |
| GB | 2275953 | A | 9/1994 |
| GB | 2299868 | A | 10/1996 |
| GB | 2386627 | A | 9/2003 |
| GB | 2432377 | A | 5/2007 |
| GB | 2435046 | A | 8/2007 |
| GB | 2457207 | A | 8/2009 |
| GB | 2458557 | A | 9/2009 |
| GB | 2459783 | A | 11/2009 |
| GB | 2467090 | B | 1/2012 |
| JP | 06228694 | A | 8/1994 |
| JP | 11264042 | A | 9/1999 |
| JP | 2002161325 | A | 6/2002 |
| RU | 2015187 | C1 | 6/1994 |
| RU | 2073696 | C1 | 2/1997 |
| RU | 2149247 | C1 | 5/2000 |
| RU | 2296217 | C1 | 3/2007 |
| SU | 337425 | | 5/1972 |
| SU | 349746 | | 9/1972 |
| SU | 358864 | A1 | 11/1972 |
| SU | 1585079 | A1 | 8/1990 |
| SU | 1733617 | A1 | 5/1992 |
| WO | 9903515 | A2 | 1/1999 |
| WO | 0161146 | A1 | 8/2001 |
| WO | 200248503 | A1 | 6/2002 |
| WO | 2005090742 | A1 | 9/2005 |
| WO | 2006023172 | A2 | 3/2006 |
| WO | 2008068645 | A1 | 6/2008 |
| WO | 2008079485 | A2 | 7/2008 |
| WO | 2008079486 | A1 | 7/2008 |
| WO | 2008079485 | A3 | 11/2008 |
| WO | 2009048822 | A2 | 4/2009 |
| WO | 2009064662 | A1 | 5/2009 |

OTHER PUBLICATIONS

Eslinger, et al., "A Hybrid Milling/Jetting Tool—The Safe Solution to Scale Milling", SPE 60700—SPE/ICoTA Coiled Tubing Roundtable, Houston, Texas, Apr. 5-6, 2000, 6 pages.

Esteban, et al., "Measurement of the Degree of Salinity of Water with a Fiber-Optic Sensor", Applied Optics, vol. 38 (25), Sep. 1999, pp. 5267-5271.

Johnson, et al., "An Abrasive Jetting Scale Removal System", SPE 46026—SPE/IC0TA Coiled Tubing Roundtable, Houston, Texas, Mar. 15-16, 1998, 6 pages.

Krohn, D.A., "Fiber Optic Sensors: Fundamentals and Applications", Instrumentation Systems, 3rd Sub Edition, Nov. 2000, 288 pages.

Maher, et al., "A Fiber Optic Chemical Sensor for Measurement of Groundwater pH", Journal of Testing and Evaluation, vol. 21(5), Sep. 1993, 5 pages.

Schlumberger, , "Jet Blaster", obtained from http://www.slb.com/media/services/resources/casestudies/stimulation/jetblaster_zarzaitine_field_zarzaitine_field_algeria.pdf, Nov. 17, 2008.

Stoop, B., "Photonic Analog-to-Digital Conversion", Springer Series in Optical Sciences, 81, published by Springer-Verlag, 2001.

Thomson, et al., "Design and Installation of a Cost-Effective Completion System for Horizontal Chalk Wells Where Multiple Zones Require Acid Stimulation", SPE 51177—SPE Drilling and Completion, vol. 13(3), 1998, pp. 151-156.

Wolfbeis, et al., "Fiber Optic Fluorosensor for Oxygen and Carbon Dioxide", Anal. Chem, vol. 60, 1998, pp. 2028-2030.

Examination Report issued in United Kingdom Application No. GB1009287.2 dated Jul. 21, 2011.

International Search Report and Written Opinion issued in PCT/US2008/082713 dated Mar. 13, 2009.

Balanyuk, "Mossbauer study and thermodynamic modeling of Fe-C-N alloy", Acta Materialia, vol. 48, No. Sep. 15, 2000, pp. 3813-3821.

Gavriljuk, et al., "Nitrogen and Carbon in Austenitic and Martensitic Steels: Atomic Interactions and Structural Stability", Materials Science Forum, vol. 426-432, Part 2, 2003, pp. 943-950.

Jargelius-Pettersson, R.F.A., "Application of the Pitting Resistance Equivalent Concept to Some Highly Alloyed Austenitic Stainless Steels", Corrosion (USA), vol. 54, No. 2, Feb. 1998, pp. 162-168.

Rawers, "Characterizing alloy additions to carbon high-nitrogen steel", Proceedings of the Institution of Mechanical Engineers, Part L: Journal of Materials: Design and Applications, vol. 218 , No. 3, Aug. 2004, pp. 239-246.

Answers.com, "Degrade: Definition, Synonyms", <http:/ /www.answers.com/topic/degrade>, Retrieved from the Internet, May 11, 2011.

Bishop, et al., "Solubility and properties of a poly(aryl ether ketone) in strong acids", Macromolecules, vol. 18, No. 1, 1985, pp. 86-93.

Lakshmi, et al., "Sulphonated poly(ether ether ketone): Synthesis and characterisation", Journal of Materials Science, vol. 40, No. 3, Feb. 2005, pp. 629-636.

Merriam-Webster Dictionary, "Tapered", Definition of tapered, Merriam-Webster; http://www.merriam-webster.com/dictionary/tapered.

Molyneux, "Water-soluble synthetic polymers: properties and behavior", CRC Press, vol. 1, 1983, 240 pages.

Raj, et al., "High Nitrogen Steels and Stainless Steels: Manufacturing, Properties and Applications", Narosa Publishing House—ASM International, New Delhi, 2004, 224 pages.

Reyna-Valencia, et al., "Structural and mechanical characterization of poly(ether ether ketone) (PEEK) and sulfonated PEEK films:

(56) References Cited

OTHER PUBLICATIONS

Effects of thermal history, sulfonation, and preparation conditions", Journal of Applied Polymer Science, vol. 99, No. 3, Feb. 5, 2006, pp. 756-774.
Roovers, et al., "Synthesis and characterization of narrow molecular-weight distribution fractions of poly(aryl ether ether ketone)", Macromolecules, vol. 23, No. 6, 1990, pp. 1611-1618.
Thomson, et al., "Design and Installation of a Cost-Effective Completion System for Horizontal Chalk Wells Where Multiple Zones Require Acid Stimulation", SPE 51177—Offshore Technology Conference, Houston, Texas, May 5-8, 1997, pp. 151-156.
Unknown Author, "www.answers.com/topic/degradeL data", Listed in notice of reference cited by examiner in U.S. Appl. No. 11/941,790.
Wang, et al., "Synthesis and molecular characterization of narrow molecular weight distribution fractions of methyl-substituted poly(aryl ether ether ketone)", Macromolecules, vol. 26, No. 15, 1993, pp. 3826-3832.
Wei-Berk, et al., "Studies on dilute solutions of phenyl ether ketone copolymers", Journal of Polymer Science Part B: Polymer Physics, vol. 28, No. 10, Sep. 1990, pp. 1873-1879.

* cited by examiner

DISSOLVABLE BRIDGE PLUG

PRIORITY CLAIM/CROSS REFERENCE TO RELATED APPLICATIONS

The present document Ser. No. 11/427,233 is a continuation in part of U.S. Pat. No. 8,211,247, entitled "Degradable Compositions, Apparatus Comprising Same, and Method of Use," which was filed on Jun. 28, 2006, which claims the benefit of U.S. Provisional patent application Ser. No. 60/771,627, which was filed on Feb. 9, 2006, the disclosures of which are incorporated herein by reference in their entireties.

FIELD

Embodiments described relate to a bridge plug configured for use in cased well operations. More specifically, embodiments of the plug are described wherein metal-based anchoring and support features may be dissolvable in a well environment, particularly following fracturing applications.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

Perforating and fracturing applications in a cased well, generally during well completion, constitute one such area where significant amounts of time and effort are spent, particularly as increases in well depths and sophisticated architecture are encountered. These applications involve the positioning of a bridge plug downhole of a well section to be perforated and fractured. Positioning of the bridge plug may be aided by pumping a driving fluid through the well. This may be particularly helpful where the plug is being advanced through a horizontal section of the well.

Once in place, equipment at the oilfield surface may communicate with the plug assembly over conventional wireline so as to direct setting of the plug. Such setting may include expanding slips and a seal of the assembly for anchoring and sealing of the plug respectively. Once anchored and sealed, a perforation application may take place above the bridge plug so as to provide perforations through the casing in the well section. Similarly, a fracturing application directing fracture fluid through the casing perforations and into the adjacent formation may follow. This process may be repeated, generally starting from the terminal end of the well and moving uphole section by section, until the casing and formation have been configured and treated as desired.

The presence of the set bridge plug in below the well section as indicated above keeps the high pressure perforating and fracturing applications from affecting well sections below the plug. Indeed, even though the noted applications are likely to generate well over 5,000 psi, the well section below the plug is kept isolated from the section thereabove. This degree of isolation is achieved largely due to the use of durable metal features of the plug, including the above noted slips, as well as a central mandrel.

Unfortunately, unlike setting of the bridge plug, wireline communication is unavailable for releasing the plug. Rather, due to the high pressure nature of the applications and the degree of anchoring required of the plug, it is generally configured for near permanent placement once set. As a result, removal of a bridge plug requires follow on drilling out of the plug. Once more, where the plug is set in a horizontal section of the well, removal of the plug may be particularly challenging. Unlike the initial positioning of the bridge plug, which may be aided by pumping fluid through the well, no significant tool or technique is readily available to aid in drillably removing the plug. Indeed, due to the physical orientation of the plug relative the oilfield surface equipment, each drill-out of a plug in a horizontal well section may require hours of dedicated manpower and drilling equipment.

Depending on the particular architecture of the well, several horizontal bridge plug drill-outs, as well as dozens of vertical drill-outs may take place over the course of conventional perforating and fracturing operations for a given cased well. All in all, this may add up to several days and several hundred thousand dollars in added manpower and equipment expenses, solely dedicated to bridge plug drill-out. Furthermore, even with such expenses incurred, the most terminal or downhole horizontal plugs are often left in place, with the drill-out application unable to achieve complete plug removal, thus cutting off access to the last several hundred feet of the well.

Efforts have been made to reduce expenses associated with time, manpower, and equipment that are dedicated to bridge plug drill-outs as described above. For example, many bridge plugs today include parts made up of fiberglass based materials which readily degrade during drill-out. However, use of such materials for the above noted slips and/or mandrel may risk plug failure during high pressure perforating or fracturing. Such failure would likely require an additional clean out application and subsequent positioning and setting of an entirely new bridge plug, all at considerable time and expense. Thus, in order to avoid such risks, conventional bridge plugs generally continue to require time consuming and labor intensive drill-out for removal, particularly in the case of horizontally positioned plugs.

SUMMARY

A bridge plug is disclosed for use in a cased well during a pressure generating application. The plug provides effective isolation during the application. However, the plug is also configured of a solid structure that is dissolvable in the well.

DETAILED DESCRIPTION

Embodiments are described with reference to certain downhole operations employing a bridge plug for well isolation. For example, embodiments herein focus on perforating and fracturing applications. However, a variety of applications may be employed that take advantage of embodiments of a dissolvable bridge plug as detailed herein. For example, any number of temporary isolations, for example to run an isolated clean-out or other application, may take advantage of bridge plug embodiments described below. Regardless, embodiments described herein include a bridge plug configured for securably anchoring in a cased well for a high-pressure application. This may be followed by a substantial dissolve of metal-based parts of the plug so as to allow for a more efficient removal thereof.

Figure 1:
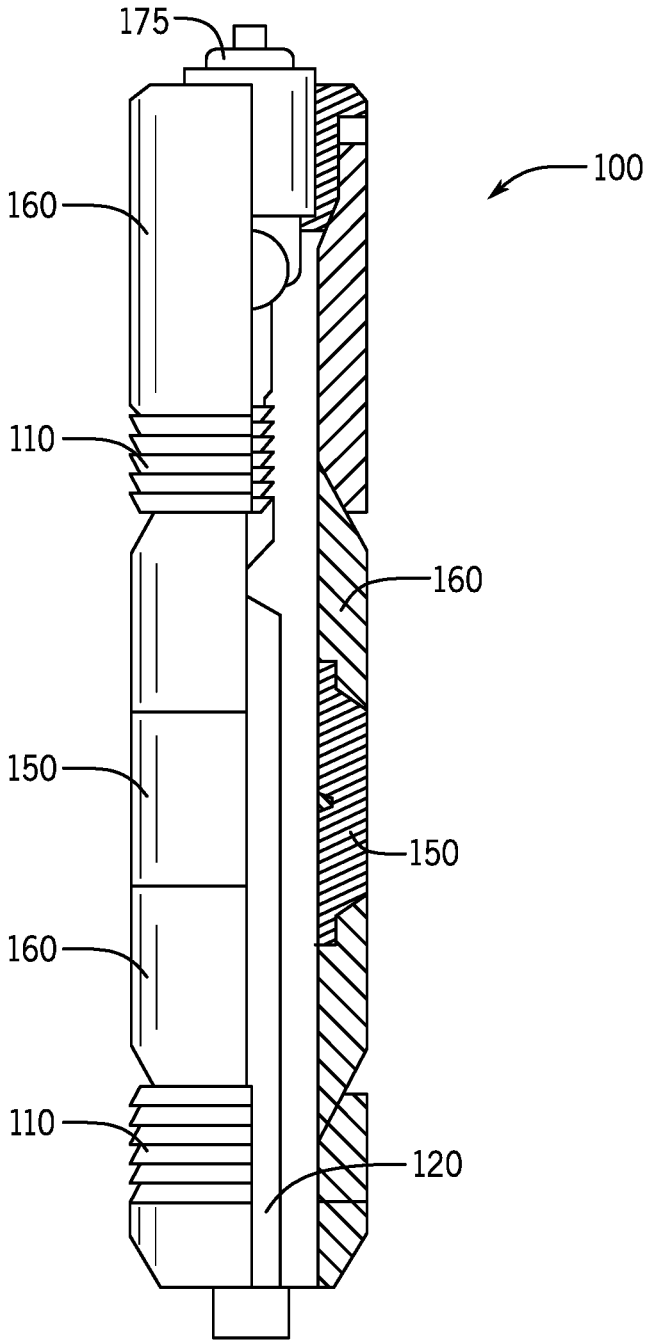
FIG. 1 is a side, partially-sectional view of an embodiment of a dissolvable bridge plug.

Referring now to FIG. 1, a side, partially-sectional view of an embodiment of a dissolvable bridge plug 100 is shown. The bridge plug 100 is referred to as 'dissolvable' in the sense that certain features thereof may be configured for passive degradation or dissolution upon exposure to downhole well conditions as detailed further below. As used herein, the term passive degradation is meant to refer to degradation upon exposure to downhole conditions, whether or not such conditions are pre-existing or induced.

In the embodiment of FIG. 1, the plug 100 includes slips 110 and a mandrel 120 which, while ultimately dissolvable, are initially of substantially high strength and hardness (e.g. L80, P110). Thus, maintaining isolation and anchoring to a casing 380 during a high pressure application may be ensured (see FIG. 3A). In one embodiment, the slips 110 and mandrel 120 are configured to withstand a pressure differential of more than about 8,000 psi to ensure structural integrity of the plug 100. Thus, a standard perforating or fracturing application which induces a pressure differential of about 5,000 psi is not of significant concern. Due to the anchoring and structural integrity afforded the plug 100, the slips 110 and mandrel 120 may be referred to herein as integrity components.

In spite of the high strength and hardness characteristics of the slips 110 and mandrel 120, their degradable or dissolvable nature allows for subsequent drill-out or other plug removal techniques to be carried out in an efficient and time-saving manner (see FIG. 3B). Incorporating a degradable or dissolvable character into the slips 110 and mandrel 120 may be achieved by use of reactive metal in construction. Namely, as detailed to a greater degree below, the slips 110 and mandrel 120 may be made up of a reactive metal such as aluminum with an alloying element incorporated thereinto. For example, as detailed in U.S. application Ser. No. 11/427,233, incorporated herein, the alloying element may be elements such as lithium, gallium, indium, zinc and/or bismuth. Thus, over time, particularly in the face of exposure to water, fracturing fluid, high temperatures, and other downhole well conditions, the material of the slips 110 and mandrel 120 may begin to degrade or dissolve.

Figure 2:
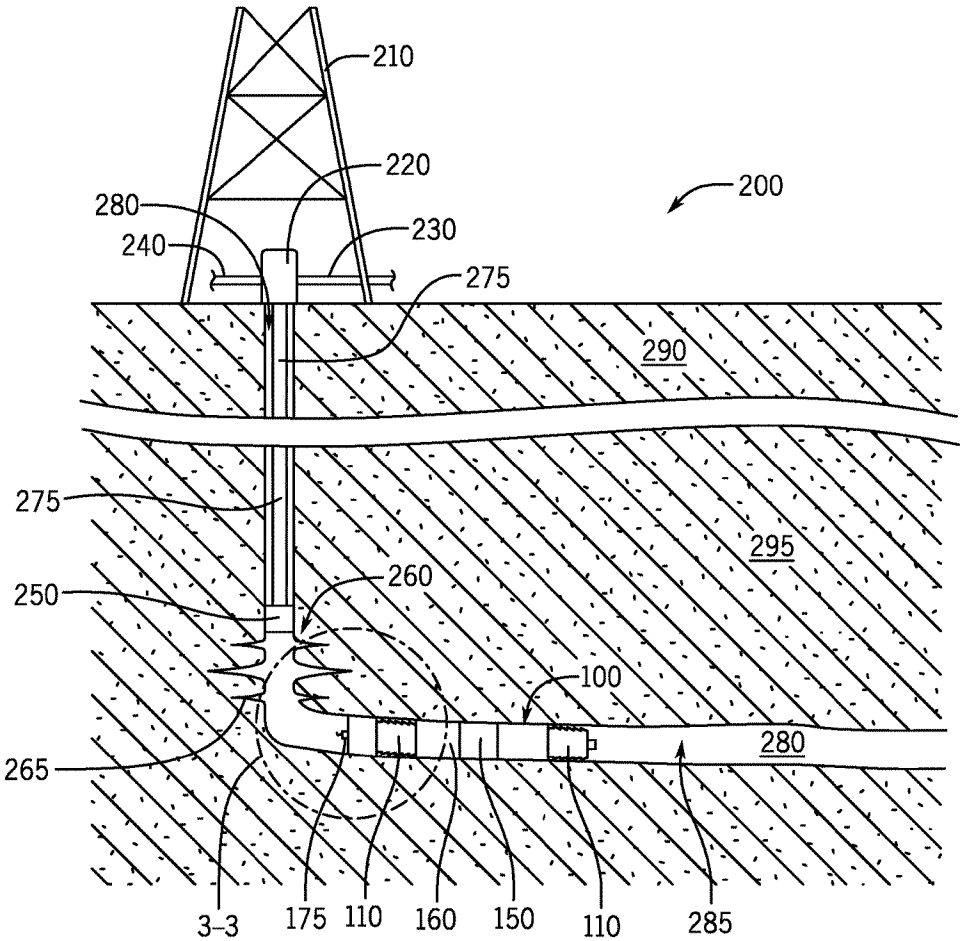
FIG. 2 is an overview of an oilfield accommodating a well with the bridge plug of FIG. 1 employed therein.

Continuing with reference to FIG. 1, with added reference to FIG. 2, the plug 100 may also include a seal 150 for isolation upon deployment in a well 280. The seal 150 may be of conventional polymer seal material. Additionally, in the embodiment shown, the plug 100 is configured for wireline deployment and equipped with a coupling 175 for securing to the wireline. The plug 100 also includes other body portions 160 which may house underlying components and/or serve as structural interfaces between the slips 110, seal 150, head 175 and other plug features.

Unlike the slips 110 and mandrel 120, none of the body portions 160, the seal 150, or the head 175 is responsible for anchoring or maintaining structural integrity of the plug 100 during a perforating, fracturing or other high pressure applications in the well 280. Thus, at the very outset material choices for these features 150, 160, 175 may be selected based on other operational parameters. For example, the polymer seal material of the seal 150 may be an elastomer selected based on factors such as radial expansiveness and likely well conditions. Similarly, the body portions 160 of the plug 100 may be a conventional polymer or fiberglass composite that is selected based on its ease of drill-out removal following a high pressure application (see FIG. 4B).

FIG. 2 is an overview of an oilfield 200 accommodating a well 280 with the bridge plug 100 of FIG. 1 employed therein. More specifically, the bridge plug 100 is employed for isolation in a terminal lateral leg 285 of the well 280. Nevertheless, in spite of the challenging architecture and potentially significant depth involved, a follow on drill-out of the plug 100 may be achieved and in a time-efficient manner as detailed below.

In the embodiment shown, a rig 210 is provided at the oilfield surface over a well head 220 with various lines 230, 240 coupled thereto for hydraulic access to the well 280. More specifically, a high pressure line 230 is depicted along with a production line 240. The production line 240 may be provided for recovery of hydrocarbons following completion of the well 280. However, more immediately, this line 240 may be utilized in recovering fracturing fluids. That is, the high pressure line 230 may be coupled to large scale surface equipment including fracturing pumps for generating at least about 5,000 psi for a fracturing application. Thus, fracturing fluid, primarily water, may be driven downhole for stimulation of a production region 260.

In the embodiment of FIG. 2, the well 280, along with production tubing 275, is shown traversing various formation layers 290, 295 and potentially thousands of feet before reaching the noted production region 260. Perforations 265 penetrating the formation 295 may be pre-formed via a conventional fracturing application. Additionally, the production tubing 275 may be secured in place uphole of the region 260 by way of a conventional packer 250. Thus, a high pressure fracturing application as directed through the production tubing 275 may be effectively directed at the region 260.

As to deployment and setting of the bridge plug 100, a variety of techniques may be utilized. For example, as noted above, wireline coupled to the head 175 may be used to drop the plug 100 down the vertical portion of the well 280. Upon reaching the lateral leg 285, hydraulic pressure may be employed to position the plug 100 therein. Once in place, the slips 110 may be wireline actuated for anchoring as described below. Similarly, the seal 150 may be compressibly actuated for sealing. In other embodiments slickline, jointed pipe, or coiled tubing may be used in deployment of the plug 100. In such embodiments, setting may be actuated hydraulically or though the use of a separate setting tool which acts compressibly upon the plug 100 for radial expansion of the slips 110 and seal 150.

Continuing with reference to FIG. 2, the bridge plug 100 may be deployed as indicated so as to isolate more downhole, most likely uncased, portions of the lateral leg 285 from the remainder of the well 280. Indeed, with the bridge plug 100 in place as shown, the fracturing application may be focused at the area of the well 280 between the plug100 and the packer 250. Thus, high pressure targeting of the perforations 265 of the production region 260 may be achieved. As noted above, subsequent recovery of fracturing fluid may follow through the production tubing 275 and line 240.

Figure 3:
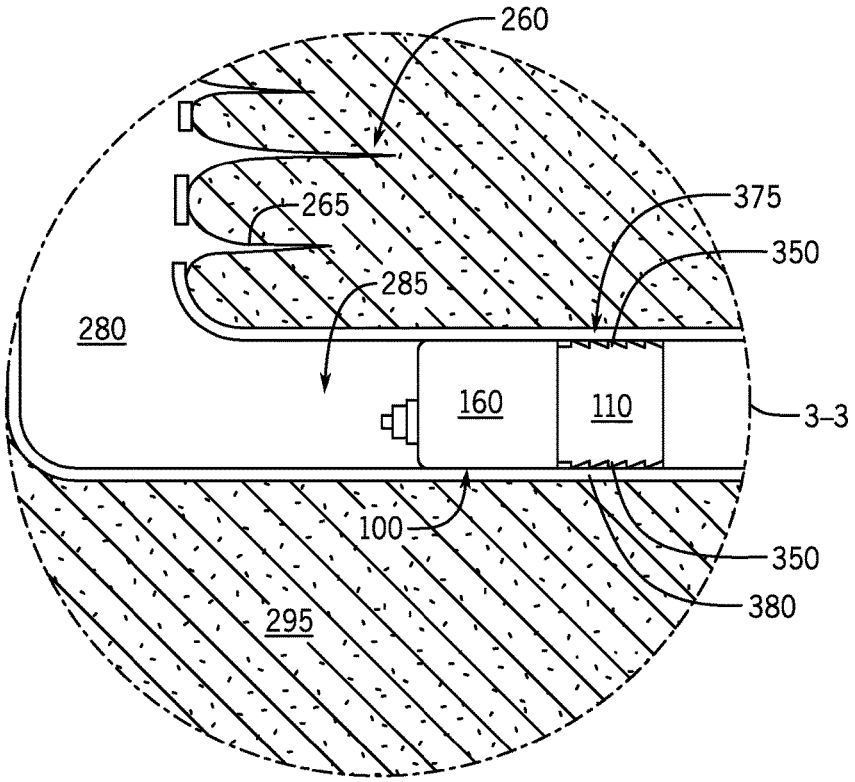
FIG. 3 is an enlarged view of a downhole area taken from 3-3 of FIG. 2 and revealing an interface of the bridge plug with a casing of the well.

Continuing with reference to FIG. 3, an enlarged view of the downhole area taken from 3-3 of FIG. 2 is shown. The well 280 is defined by conventional casing 380 which extends at least somewhat into more uphole portions of the lateral leg 285. In this view, the interface 375 of the plug 100 with casing 380 defining the well 280 is depicted. It is at this interface 375 where teeth 350 of the visible slip 110 are shown digging into the casing 380, thereby anchoring the plug 100 in place. Indeed, in spite of differential pressure potentially exceeding about 5,000 psi during the noted fracturing application, or during the preceding perforating, the slips 110 help keep the plug 100 immobilized as shown. Similarly, with added reference to FIG. 1, the internal mandrel 120 helps to ensure structural integrity of the plug 100 in the face of such high pressures. Indeed, as noted above, the mandrel 120 may be rated for maintaining structural integrity in the face of an 8,000-10,000 psi or greater pressure differential.

Figure 4A:
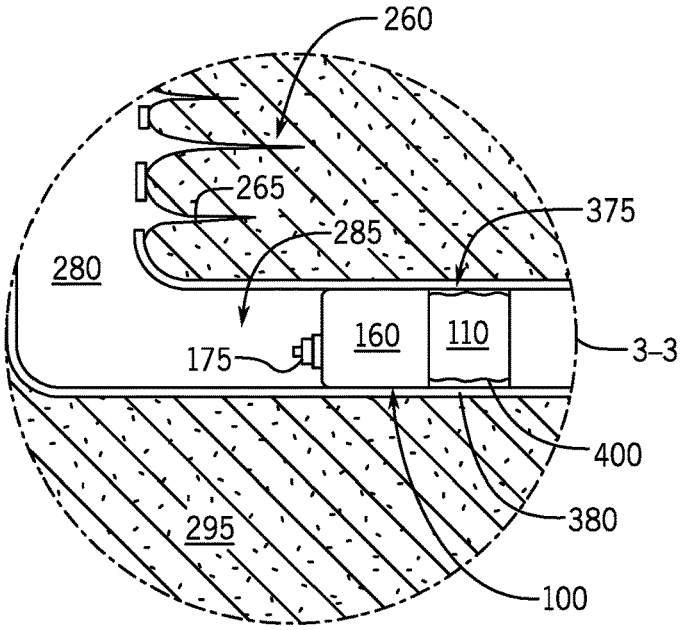
FIG. 4A is the enlarged view of FIG. 3 now revealing the dissolvable nature of a slip of the bridge plug and the changing interface as a result.
Figure 4B:
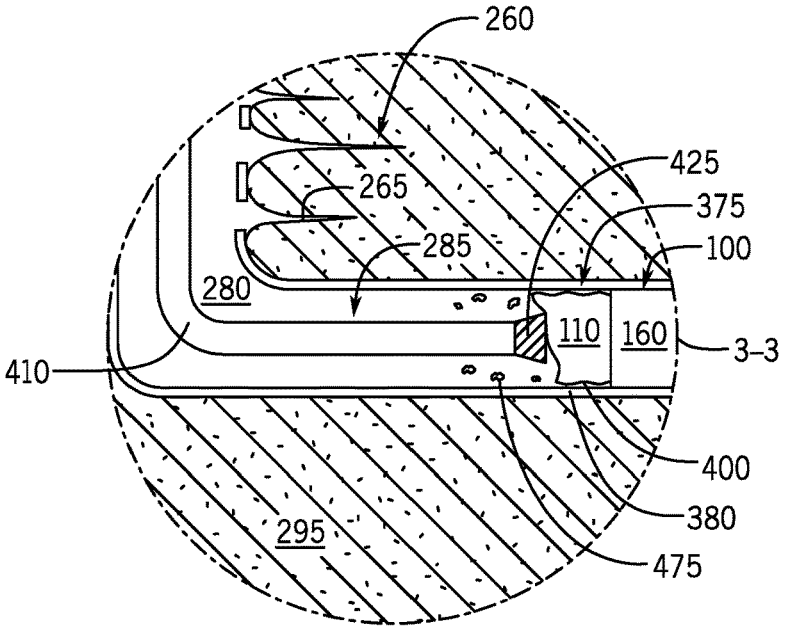
FIG. 4B is the enlarged view of FIG. 4A now depicting a drill-out application as applied to the substantially dissolved bridge plug.

Referring now to FIG. 4A, the enlarged view of FIG. 3 is depicted following a dissolve period with the bridge plug 100 in the well 280. Noticeably, the visible slip 110 has undergone a degree of degradation or dissolve over the dissolve period. Indeed, the underlying support structure for the teeth 350 of the slip 110 as shown in FIG. 3 has eroded away. Thus, the teeth 350 are no longer supported at the casing 380. This leaves only an eroded surface 400 at the interface 375. As a result, the plug 100 is no longer anchored by the slips 110 as described above. The internal support structure of the mandrel 120 of FIG. 1 is similarly degraded over the dissolve period. As a result, a follow-on drill-out application as depicted in FIG. 4B may take place over the course of less than about 30 minutes, preferably less than about 15 minutes. This is a significant reduction in drill-out time as compared to the several hours or complete absence of drill-out available in the absences of such dissolve.

The dissolve rate of the plug 100 may be tailored by the particular material choices selected for the reactive metals and alloying elements described above. That is, material choices selected in constructing the slips 110 and mandrel 120 of FIG. 1 may be based on the downhole conditions which determine the dissolve rate. For example, when employing reactive metals and alloying element combinations as disclosed herein and in the '233 Application, incorporated herein by reference as detailed above, the higher the downhole temperature and/or water concentration, the faster the dissolve rate.

Continuing with reference to FIG. 4A, with added reference to FIG. 1, downhole conditions which affect the dissolve rate may be inherent or pre-existing in the well 280. However, such conditions may also be affected or induced by applications run in the well 280 such as the above noted fracturing application. That is, a large amount of fracture fluid, primarily water, is driven into the well 280 at high pressure during the fracturing operation. Thus, the exposure of the slips 110 and mandrel 120 to water is guaranteed in such operations. However, if the well 280 is otherwise relatively water-free or not of particularly high temperature, the duration of the fracturing application may constitute the bulk of downhole conditions which trigger the dissolve. Alternatively, the well 280 may already be water producing or of relatively high temperature (e.g. exceeding about 75° C.). In total, the slips 110 and mandrel 120 are constructed of materials selected based on the desired dissolve rate in light of downhole conditions whether inherent or induced as in the case of fracturing operations. Further, where the conditions are induced, the expected duration of the induced condition (e.g. fracturing application) may also be accounted for in tailoring the material choices for the slips 110 and mandrel 120.

While material choices may be selected based on induced downhole conditions such as fracturing operations, such operations may also be modulated based on the characteristics of the materials selected. So, for example, where the duration of the fracturing application is to be extended, effective isolation through the plug 100 may similarly be extended through the use of low temperature fracturing fluid (e.g. below about 25° C. upon entry into the well head 220 of FIG. 2). Alternatively, where the fracture and dissolution periods are to be kept at a minimum, a high temperature fracturing fluid may be employed.

Compositions or material choices for the slips 110 and mandrel 120 are detailed at great length in the noted '233 Application. As described, these may include a reactive metal, which itself may be an alloy with structure of crystalline, amorphous or both. The metal may also be of powder-metallurgy like structure or even a hybrid structure of one or more reactive metals in a woven matrix. Generally, the reactive metal is selected from elements in columns I and II of the Periodic Table and combined with an alloying element. Thus, a high-strength structure may be formed that is nevertheless degradable.

In most cases, the reactive metal is one of calcium, magnesium and aluminum, preferably aluminum. Further, the alloying element is generally one of lithium, gallium, indium, zinc, or bismuth. Also, calcium, magnesium and/or aluminum may serve as the alloying element if not already selected as the reactive metal. For example, a reactive metal of aluminum may be effectively combined with an alloying element of magnesium in forming a slip 110 or mandrel 120.

In other embodiments, the materials selected for construction of the slips 110 and mandrel 120 may be reinforced with ceramic particulates or fibers which may have affect on the rate of degradation. Alternatively, the slips 110 and mandrel 120 may be coated with a variety of compositions which may be metallic, ceramic, or polymeric in nature. Such coatings may be selected so as to affect or delay the onset of dissolve. For example, in one embodiment, a coating is selected that is itself configured to degrade only upon the introduction of a high temperature fracturing fluid. Thus, the dissolve period for the underlying structure of the slips 110 and mandrel 120 is delayed until fracturing has actually begun.

The particular combinations of reactive metal and alloying elements which may be employed based on the desired dissolve rate and downhole conditions are detailed at great length in the noted '233 Application. Factors such as melting points of the materials, corrosion potential and/or the dissolvability in the presence of water, brine or hydrogen may all be accounted for in determining the makeup of the slips 110 and mandrel 120.

In one embodiment, the dissolve apparent in FIG. 4A may take place over the course of between about 5 and 10 hours. During such time, a perforating application may be run whereby the perforations 265 are formed. Further, a fracturing application to stimulate recovery from the formation 295 through the perforations 265 may also be run as detailed above. Additionally, to ensure that the plug 100 maintains isolation throughout the fracturing application, the dissolve rate may be intentionally tailored such that the effective life of the plug 100 extends substantially beyond the fracturing application. Thus, in one embodiment where hydrocarbon recovery is possible downhole of the plug 100, the plug 100 may be actuated via conventional means to allow flow therethrough. This may typically be the case where the plug 100 is employed in a vertical section of the well 280.

Referring now to FIG. 4B, the enlarged view of FIG. 4A is depicted, now showing a drill-out application as applied to the substantially dissolved bridge plug 100. That is, once sufficient dissolve has taken place over the dissolve period, a conventional drill tool 410 with bit 425 may be used to disintegrate the plug 100 as shown. Indeed, in spite of the potential excessive depth of the well 280 or the orientation of the plug in the lateral leg 285, a drill-out as shown may be completed in a matter of less than about 15 minutes (as opposed to, at best, several hours). This, in spite of the durability, hardness and other initial structural characteristics of the slips 110 and mandrel 120 which allowed for effective high pressure applications uphole thereof (see FIGS. 1 and 2).

Figure 5:
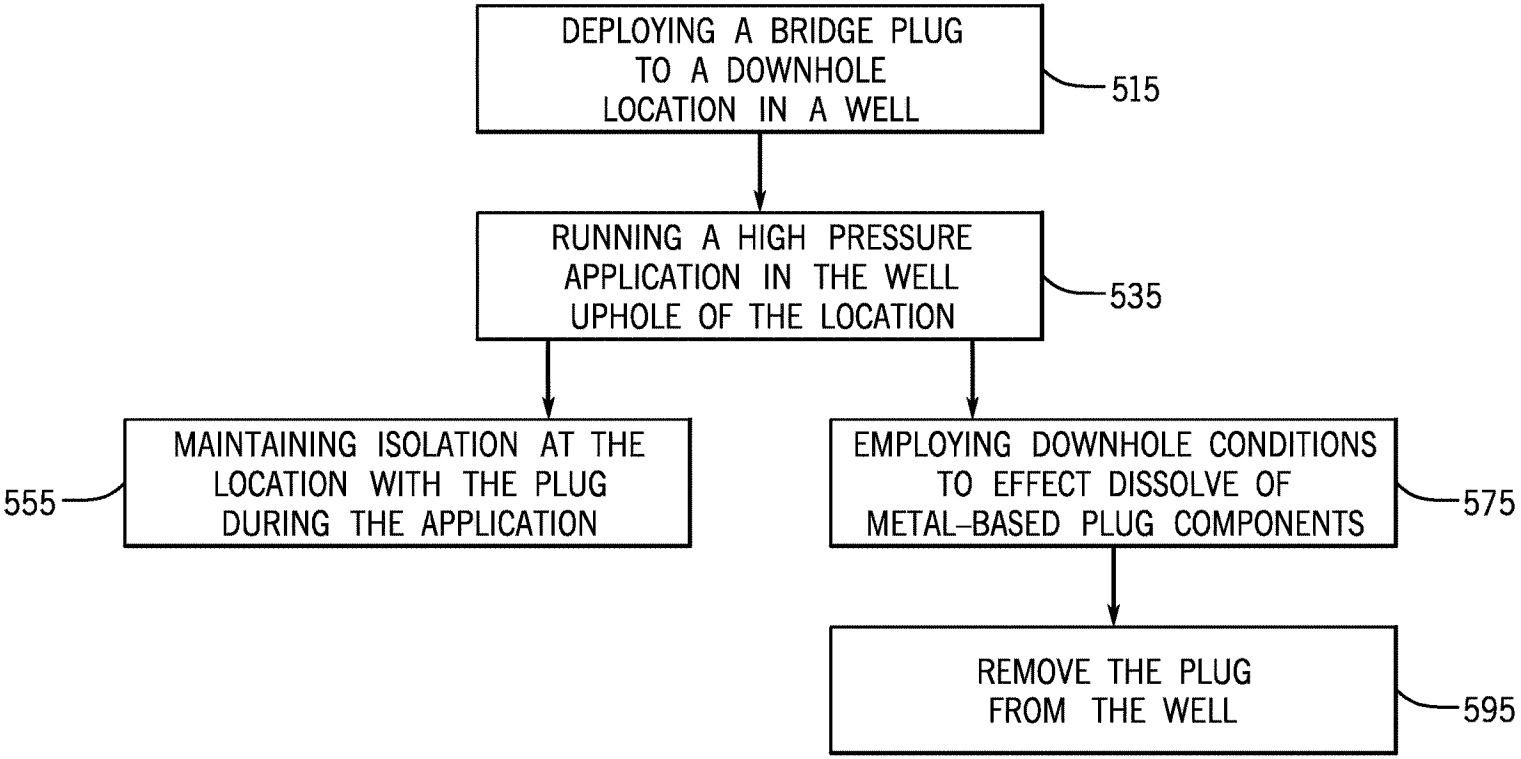
FIG. 5 is a flow-chart summarizing an embodiment of employing a dissolvable bridge plug in a well.

Referring now to FIG. 5, a flow-chart is shown summarizing an embodiment of employing a dissolvable bridge plug in a well. The bridge plug is delivered and set at a downhole location as indicated at 515 and described hereinabove. Thus, as shown at 535, a high pressure application may be run uphole of the location while isolation is maintained by the plug (see 555). However, by the same token, as indicated at 575, downhole conditions, whether introduced by the high pressure application or otherwise, may be used to effect dissolve of metal-based components of the plug. As a result, the plug may be effectively removed from the well as indicated at 595. This may be achieved by way of fishing, drill-out as described hereinabove, or even by bluntly forcing the plug remains to an unproductive terminal end of the well. Regardless the manner, the removal may now take a matter of minutes as opposed to hours (or failed removal altogether).

Embodiments described hereinabove provide a bridge plug and techniques that allow for effective isolation and follow on removal irrespective of the particular architecture of the well. That is, in spite of the depths involved or the lateral orientation of plug orientation, drill-out or other removal techniques may effectively and expediently follow an isolated application uphole of the set plug. The degree of time savings involved may be quite significant when considering the fact that completions in a given well may involve several bridge plug installations and subsequent removals. This may amount to several days worth of time savings and hundreds of thousands of dollars, particularly in cases where such installations and removals involve a host of horizontally oriented plugs.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A temporary bridge plug for deployment in a well, the temporary bridge plug comprising:

an integrity component for maintaining one of anchoring integrity and structural integrity in the well during a pressure generating application uphole thereof, said integrity component configured for substantially dissolving in the well and comprised of a material comprising:

a reactive metal selected from a group consisting of aluminum, calcium and magnesium; and an alloying element different from the reactive metal selected from a group consisting of gallium, indium, and bismuth for tailoring a rate of the dissolving, wherein the integrity component comprises a mandrel.

2. The temporary bridge plug of claim 1 wherein the pressure generating application generates in excess of about 5,000 psi.

3. The temporary bridge plug of claim 1 wherein said integrity component comprises a slip for the anchoring integrity.

4. The temporary bridge plug of claim 3 wherein the slip comprises teeth for interfacing a casing upon radial expansion of the slip.

5. The temporary bridge plug of claim 1 further comprising:

a radially expansive seal; and a composite material body portion adjacent said radially expansive seal and said integrity component.

6. The temporary bridge plug of claim 5 wherein said radially expansive seal is a drillable elastomer and said composite material body portion is a drillable fiberglass.

7. A method comprising:

deploying a temporary bridge plug for isolation at a downhole location of a well, said temporary bridge plug of a material comprising:

a reactive metal material selected from a group consisting of aluminum, calcium and magnesium; and an alloying element material selected from a group consisting of lithium, gallium, indium, zinc, and bismuth for tailoring a rate of dissolving, wherein the alloying element material is different from the reactive metal material;

running a pressure generating application in the well uphole of the downhole location;

maintaining the isolation with an integrity component of the temporary bridge plug during said running, the integrity component tailored from the reactive metal material and the alloying element material;

substantially dissolving the integrity component at an enhanced rate based upon the tailored material composition thereof, and based upon well conditions, wherein the well conditions comprise temperature, water concentration, or duration of the pressure generating application, or some combination thereof; and subsequently introducing a retrieval tool for interventionally removing the temporary bridge plug from the downhole location.

8. The method of claim 7 wherein the application is one of perforating and fracturing.

9. The method of claim 7 further comprising tailoring parameters of the application to affect the well conditions for said dissolving.

10. The method of claim 7 wherein the integrity component is an anchoring slip, said deploying comprising:

delivering the temporary bridge plug at the downhole location through one of wireline, slickline, jointed pipe, and coiled tubing; and anchoring the temporary bridge plug at the downhole location through radial expansion of the anchoring slip.

11. The method of claim 10 further comprising radially expanding a seal of the temporary bridge plug to provide hydraulic isolation of the well at the downhole location.

12. The method of claim 11 further comprising employing a setting tool for compressibly interfacing the temporary bridge plug to actuate said anchoring and said expanding.

13. The method of claim 7 further comprising recovering a hydrocarbon flow through the temporary bridge plug prior to said interventionally removing.

14. The method of claim 7 wherein said interventionally removing comprises one of fishing of the temporary bridge plug, drill-out of the temporary bridge plug, and pushing the temporary bridge plug into an open-hole portion of the well.

15. A component for incorporation into a temporary bridge plug configured for isolation in a well, the component of a dissolvable material comprising:

a reactive metal selected from a group consisting of calcium and magnesium; and an alloying element different from the reactive metal selected from a group consisting of gallium, indium, and bismuth for tailoring a rate of dissolving of the component, wherein the component comprises a mandrel.

16. The component of claim 15 configured for maintaining one of anchoring integrity and structural integrity of the temporary bridge plug during a pressure generating application in the well.

17. The component of claim 15 wherein the dissolvable material further comprises one of a reinforcing fiber and particulate.

18. The component of claim 15 further comprising a coating thereover to affect onset of dissolving of the dissolvable material when the temporary bridge plug is in the well.

19. A well assembly comprising:

a well;

a pressure generating tool disposed in said well for an application thereat; and a temporary bridge plug deployed at a location of said well downhole of said tool and with an integrity component for maintaining one of anchoring integrity and structural integrity in the well during a pressure generating application through the pressure generating tool, the integrity component for substantially dissolving in the well and comprising a reactive metal with an alloying element different from the reactive metal, the alloying element selected from a group consisting of lithium, gallium, indium, and bismuth for tailoring a rate of the dissolving, wherein the integrity component is configured to dissolve at the rate based upon well conditions, wherein the well conditions comprise temperature, water concentration, or duration of the pressure generating application, or some combination thereof.

20. The well assembly of claim 19 wherein said well further comprises a lateral leg defining a terminal end of said well, the location in the lateral leg.

* * * * *